US006681896B1

(12) United States Patent
Davis

(10) Patent No.: US 6,681,896 B1
(45) Date of Patent: Jan. 27, 2004

(54) SYSTEM AND METHOD FOR MONITORING A BAG SUPPLY IN A SELF-CHECKOUT STATION

(75) Inventor: Kevin Davis, Suwanee, GA (US)

(73) Assignee: NCR Corporation, Dayton, OH (US)

( * ) Notice: Subject to any disclaimer, the term of this patent is extended or adjusted under 35 U.S.C. 154(b) by 92 days.

(21) Appl. No.: 10/099,788

(22) Filed: Mar. 15, 2002

(51) Int. Cl.[7] ..... G01B 5/02
(52) U.S. Cl. ..... 186/66
(58) Field of Search ..... 186/66, 52, 59; 705/28; 340/568.1, 568.2, 568.5; 221/2, 6, 7

(56) References Cited

U.S. PATENT DOCUMENTS

| | | | | | |
|---|---|---|---|---|---|
| 2,909,020 | A | * | 10/1959 | Mersky | 53/390 |
| 3,075,324 | A | * | 1/1963 | Burks et al. | 53/492 |
| 3,715,862 | A | * | 2/1973 | Schohl | 53/390 |
| 3,740,922 | A | * | 6/1973 | Liou | 53/571 |
| 5,437,346 | A | * | 8/1995 | Dumont | 186/61 |
| 5,641,039 | A | * | 6/1997 | Dumont | 186/61 |
| 5,642,791 | A | * | 7/1997 | Zerlin et al. | 186/66 |
| 5,971,593 | A | * | 10/1999 | McGrady | 700/233 |

FOREIGN PATENT DOCUMENTS

| | | | | |
|---|---|---|---|---|
| EP | 0.484.299 A1 | * | 5/1992 | A47F/9/04 |

* cited by examiner

*Primary Examiner*—Donald P. Walsh
*Assistant Examiner*—Mark J. Beauchaine
(74) *Attorney, Agent, or Firm*—Maginot, Moore & Beck LLP; Paul W. Martin

(57) ABSTRACT

A monitoring system signals a low bag supply condition in a bag supply of a self-checkout station before the bag supply is depleted and requires immediate attention to enable use of the self-checkout station. The monitoring system includes a low bag supply sensor that detects the removal a bag from the bagwell of the self-checkout station. A counter then records the detection of a bag removal either by incrementing an accumulated count of removed bags or by decreasing a count of the number of bags in a supply. A signal generator generates a low bag supply signal in response to the count exceeding a low bag supply threshold. The threshold corresponds to the number of remaining bags or the number of bags removed depending upon the direction of the counting. The low bag supply signal may be a visual or audible signal sent to an attendant's station so the attendant may schedule the replenishment of the bag supply at a time when the self-checkout station is not being heavily used. The bag removal sensor may be a scale monitor, a movable arm that engages the bags of the bag supply, or a radiation detector that recognizes fluctuations in radiation levels as bag removals. The monitoring system enables an attendant of multiple self-checkout stations to remain available for customer assistance rather than being diverted by station maintenance.

17 Claims, 5 Drawing Sheets

SYSTEM AND METHOD FOR MONITORING A BAG SUPPLY IN A SELF-CHECKOUT STATION

FIELD OF THE INVENTION

This invention relates generally to self-checkout stations and, more particularly, to bagwells and bag supplies in self-checkout stations.

BACKGROUND OF THE INVENTION

Self-checkout stations at grocery stores and other retail stores are well known. The stations permit a consumer to scan items for purchase so the station may identify the items and a corresponding price. When the consumer indicates all items for purchase have been presented to the terminal, a sub-total is accumulated, any taxes and discounts are computed, and a total amount due is displayed for the consumer. The station then allows the consumer to select a payment method. The station presents menu selections to the consumer so funds are transferred to the retailer's account. Upon confirmation of payment, the items are released to the consumer.

A self-checkout station typically includes a terminal, a scanner and scales for reading unit price codes (UPC) and determining item weight, a cashier keypad and display, a POS terminal for payment entry, a receipt printer, a change unit, and a checkout area for holding items once they have been scanned. The terminal also includes a display, a processor, memory, programmed instructions, and data peripherals to control the operations of the station. The programmed instructions may contain modules for querying for item prices, computing totals and performing other functions related to the purchase of items through a self-checkout station. Some checkout station may also include a security application program that operates to reduce the likelihood that the consumer leaves without scanning all of the items or exchanges scanned items with more expensive items that have not been scanned.

Typically, two or more self-checkout stations are located proximately to one another with an attendant station nearby. The attendant may help consumers who may be using a self-checkout station for the first time, who are having trouble with scanning an item, or who are having difficulty with a payment method or the like. That is, the primary duty of the attendant is to provide assistance to customers who are using the self-checkout stations so they are efficiently used and quickly process customers with their checkouts. Although these attendants are available for reloading paper supplies for receipt printers and the like, such system maintenance duties actually detract from the performance of their primary duty.

In known self-checkout stations, a bagwell is provided in which one or more substantially horizontal members are mounted for holding a supply of bags. The bags are typically made of plastic or other polymer material and are collapsed to increase the bag capacity for a given volume of space. The bags typically have two walls that are joined at two side seams and a bottom seam so the walls oppose one another when the bag is opened. Integrally formed with these walls are typically U-shaped handles by which the bags may be carried when they are filled. In use, a customer pulls the outboard handle of the next available bag away from inboard handle to open the bag so items may be deposited in the bag during checkout. The position of the inboard handle on the extending member(s) that hold the bag supply help keep the bag open until the customer pulls the inboard handle from the extending member(s) to remove the bag from the bagwell. Typically, two or more sets of extending members are provided in the bagwell to hold bag supplies in a self-checkout station.

Of course, as customers remove their bags from the bagwell, they deplete the supply of bags for the self-checkout station. One resulting condition that frustrates the efficient use of self-checkout stations is exhausted bag supplies in a bagwell. In response to a customer's exasperation over approaching a self-checkout station with depleted bag supplies, the self-checkout station attendant searches for one or more supplies of bags and reloads the extending members in the bagwell. However, during the interlude in which the attendant is searching for the bag supplies and placing the bags on the extending members, customers may be experiencing difficulties in using another self-checkout station and require instructional guidance from the attendant. As noted above, system maintenance diverts the attendant from performing the primary duty for which the attendant is placed at the attendant station.

What is needed is a way of notifying an attendant of a low bag supply before the supply is depleted so the attendant may schedule the reloading of the bag supply during a time when customers do not require immediate attention.

SUMMARY OF THE INVENTION

The above-noted limitations of bag supplies in previously known self-checkout stations have been overcome by a system and method that operate in accordance with the principles of the present invention. The system of the present invention comprises a bag supply monitor for measuring a bag supply in a checkout counter and a low supply signal generator coupled to the bag supply monitor for generating a low bag supply signal in response to the bag supply monitor detecting a low bag supply. The bag supply monitor may include a bag removal sensor for detecting removal of a bag from the bag supply and a counter coupled to the sensor for counting the number of bags detected by the bag removal sensor. The bag removal sensor may be comprised of the scale for the self-checkout station and a monitor program that receives weight data from the scale. When the monitor program detects an increase of weight on the scale followed by the return of the weight reading to approximately a no load balance, the monitor program detects a bag removal and may increment or decrement a counter for recording the bag removal. When the monitor program determines the count exceeds a low threshold or a high threshold, depending upon the direction of the bag counting, a low supply signal may be generated. The low supply signal may be a visual or audible indicator at the attendant station or the self-checkout counter. In response, the attendant may then search for another bag supply as conditions allow so the bag supply may be reloaded when the stations are not being heavily used or a customer does not require assistance.

In another embodiment of the invention, the sensor may be a movable arm mounted proximately one of the bags in the bag supply so it engages the outboard wall of the bag. When the bag is removed, the movable arm rotates outwardly away from the bag until the bag slides past the arm. The arm may be biased by a biasing member, such as a spring or the like, or it may be mounted vertically so it is biased by gravity. When the movable arm returns under the biasing force to a position proximate the outboard wall of the next bag, it is ready to detect the removal of the next bag. The movement of the arm opens and closes an electrical switch so the bag removal may be detected. The moveable arm may be located against a bag within the bag supply so the removal of that bag and subsequent bags indicates a low bag supply. Alternatively, the moveable arm may be located against the outermost bag of the supply so the counter may count each bag as it is removed. The movable arm may be mounted at the end of a horizontally displaceable member that is biased to retract within the bagwell towards the back wall of the bagwell. The biased retraction of the horizontally displaceable member urges the movable arm into engagement with the outermost bag of the bag supply so it is in position to count the next bag removal.

In yet another embodiment of the present invention, the bag removal sensor may be a light or other radiation detector. Such a detector may be located proximate the bagwell so that the opening of a bag and depositing items in it attenuates the reception of light or other radiation by the detector and the removal of the bag enables increased reception of the light or other radiation. This change in light or other radiation reception may be correlated to bag removal. Locating the radiation detector against one of the bags within the bag supply causes the detector to generate a bag removal signal when that bag is removed. The bag removal signal is used by the low bag supply to generate the low bag supply signal for the attendant. The radiation detector may also be mounted at the end of a horizontally displaceable member that is biased to retract within the bagwell towards the back wall of the bagwell. The biased retraction of the horizontally displaceable member urges the radiation detector into engagement with the outermost bag of the remaining bag supply after a bag is removed. As each bag is filled and removed, the detector generates a bag removal signal that may be counted by the counter. When the count exceeds the low bag supply threshold, the low bag supply generator generates the low bag supply signal.

In another embodiment of the present invention the bag supply monitor includes a biased, retractable arm having an outboard end that remains proximate the next available bag of a bag supply. As the bag supply diminishes the biasing force retracts the arm. The length of the retracted arm may be measured and used as an indication of how much of the bag supply has been used or the length of the arm extending into the bagwell may be measured to determine the amount of the remaining bag supply. Similarly, a row of radiation detectors may be used to determine the amount of remaining or used bag supply. Preferably, the radiation detectors may be mounted along the bottom wall of the bagwell so they detect increasing ambient light as the bags are removed so the detectors are exposed to the ambient light.

The method of the present invention includes detecting the removal of a bag from the bagwell of a self-checkout station; counting the detected removal of a bag; and generating a low bag supply signal in response to the removal bag counting exceeding a low bag supply threshold. The removal of a bag may be detected from the movement of a biased arm, the change in a measured weight on a scale incorporated with the self-checkout station, or the attenuation of radiation reception at a radiation detector. The low bag supply threshold may correspond to a remaining number of bags in the supply or to a number of removed bags. The method also re-initializes the counter in response to the reloading of the bag supply. The low bag supply signal generated by the method may be a visual or audible signal sent to the attendant's station or activated at the self-checkout station.

It is an object of the present invention to provide an indication of a low bag supply for a checkout station before depletion of the bag supply.

It is an object of the present invention to generate a signal regarding low bag supply so the attendant may schedule the reloading of the bag supply.

It is an object of the present invention to enable attendants of self-checkout stations to remain available for instructing customers regarding the use of a self-checkout station.

These and other advantages and features of the present invention may be discerned from reviewing the accompanying drawings and the detailed description of the invention.

BRIEF DESCRIPTION OF THE DRAWINGS

The present invention may take form in various system and method components and arrangement of system and method components. The drawings are only for purposes of illustrating an exemplary embodiment and are not to be construed as limiting the invention.

DETAILED DESCRIPTION OF THE INVENTION

Figure 1:
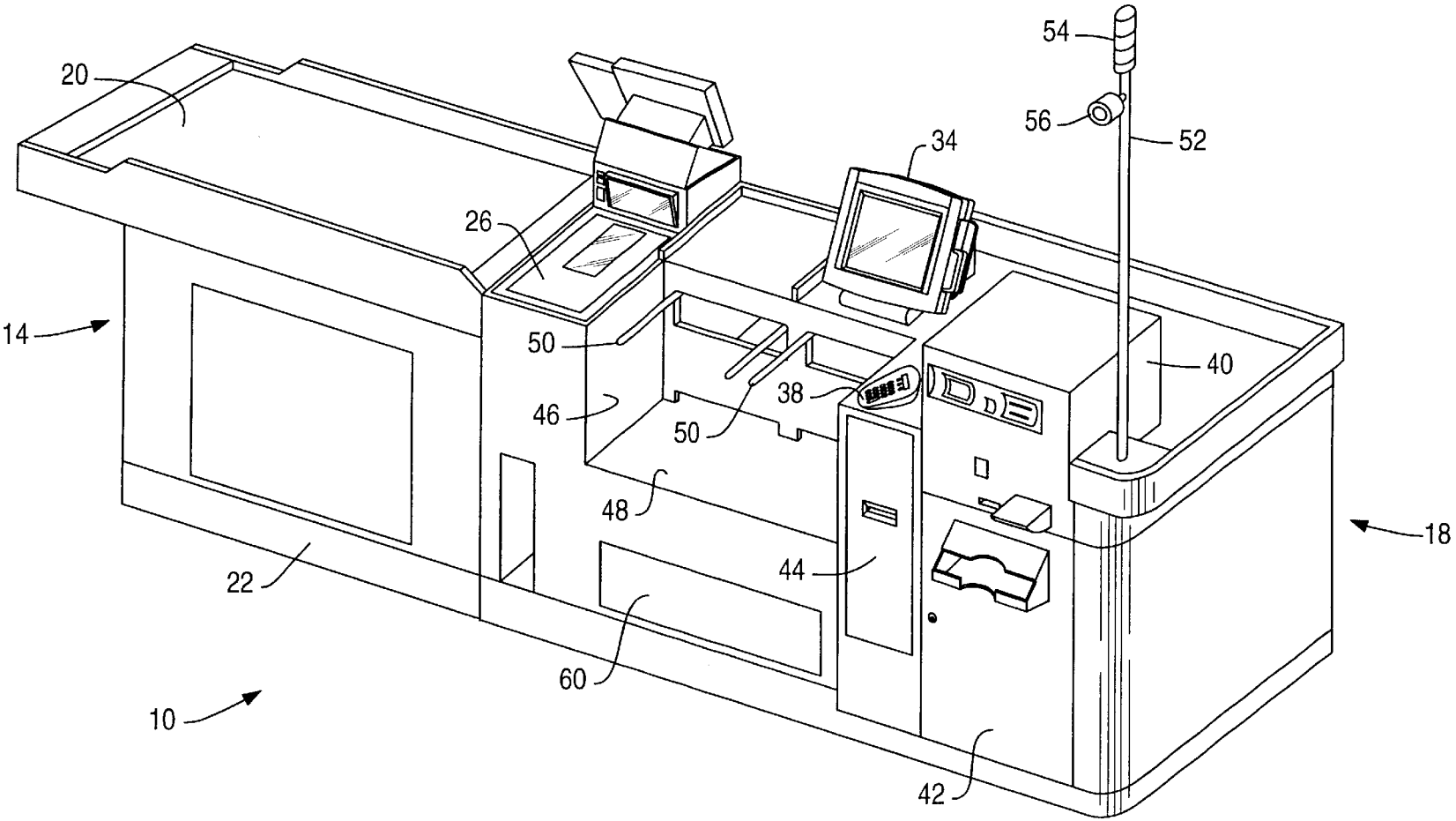
FIG. 1 depicts a self-checkout station in which the system and method of the present invention may be used.

A checkout station incorporating the system and method of the present invention is shown in FIG. 1. Checkout station 10 may include a feeder unit 14 and a checkstand 18. Feeder unit 14 includes a feeder belt 20 and housing 22 for the motor and control circuitry that operates feeder belt 20. Feeder unit 14 is movably coupled to checkstand 18 so the feeder belt may be aligned with scanner/scale unit 26. Checkstand 18 includes scanner/scale unit 26, consumer terminal 34, a payment terminal 38 for entry of payment data, and receipt printer 44. Scanner/scale unit 26 uses a laser shining on a glass or other transparent platen to input data from bar codes applied to products or packages. Unit 26 may also include a scale for measuring the weight of items that are sold on a price/unit of weight basis. Consumer terminal 34 displays item data as it is entered through scanner/scale unit 26. Payment terminal 38 may be any known POS terminal that incorporates a keypad and card reader to support credit card, debit card, and other payment methods. Receipt printer 44 provides a consumer with a receipt itemizing the items purchased and the method of payment.

Separating receipt printer 44 and scanner/scale unit 26 is a bagwell 46 having a security scale 48 for its floor. Bags for storing items that consumers have scanned and weighed are hung from hanging rails 50 in bagwell 46. Security scale 48 uses item weight data derived from scanner/scale 26 or a database using a scanned unit product code (UPC) to verify that only the items scanned are placed on the security scale. Security application programs operating within terminal 34 monitor security scale 48 to determine whether items not scanned have been added to the security scale area. An anomalous condition that requires investigation may be signaled by lighting a warning or alert light color within the tri-color indicator mounted at the terminal end of indicator pole 52 of checkstand 18. Indicator pole 52 may also have mounted thereon a security camera for providing a video signal to a security officer surveillance area or to some storage media. A database, disk drive, or other computer peripheral required for station operation may be housed within peripheral tray 60 located within checkstand 18. Checkstand 18 also includes upper currency module 40 for receiving currency and coins from a consumer as payment for a transaction while lower currency module 42 returns change to a consumer.

As shown in FIG. 1, a consumer may place items on feeder belt 20 and belt 20 is driven to bring items to the end of belt 20 where a shut-off mechanism stops belt 20. The consumer may then remove items from belt 20 and move them, one at a time, by scanner/scale 26 for item product data retrieval and/or weighing. The scanned items may then be placed in bags on security scale 48. Once all of the items are scanned, a consumer may provide payment through payment terminal 38 or currency module 40, receive change from module 44, and a receipt from printer 44. The consumer may then remove the bags from security scale 48 and leave station 10.

In one embodiment of the present invention, scale 48 and a monitor program that may reside in the computer that controls the security for the checkout stand may be used to monitor the bag supply. The monitor program detects the weight measured as scanned items are placed in the bag. When the weight on the scale returns to approximately zero, the monitor program determines a loaded bag has been removed. A low bag supply threshold may then be decremented and when the value reaches zero, a low bag supply signal is generated. Alternatively, each loaded bag removal is accumulated and the current accumulated total compared to a low bag supply threshold. When the current accumulated total and low bag supply threshold are equal, a low bag supply signal is generated. The low bag supply threshold is preferably set by the program in response to a reset signal activated by the attendant when the bag supply is replenished. The low bag supply threshold value is preferably less than a full bag supply so the bag supply is not exhausted when the low bag supply signal is generated and the attendant may schedule the reloading of the bag supply for a convenient time.

Figure 2:
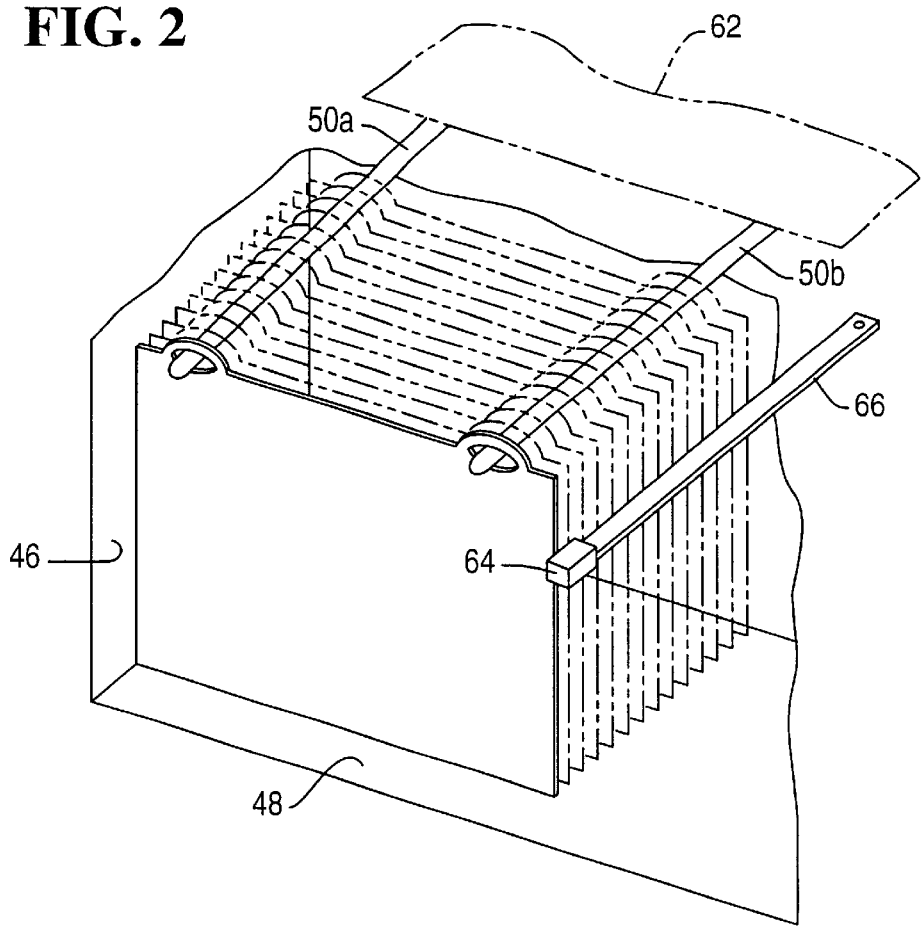
FIG. 2 depicts the bagwell of the station shown in FIG. 1 and the system having a movable arm may be used to monitor the bag supply in the bagwell of the station.

Bagwell 46 of the checkout stand is shown in greater detail in FIG. 2. Scale 48 forms the bottom wall of bagwell 46. Extending from shelf 62 are hanging arms 50*a* and 50*b* around which the handles of the bags in a bag supply may be mounted. Extending from the back wall of bagwell 46 is a horizontal member 66 to which a bag supply monitor 64 has been mounted. To maintain a movable arm extending from monitor 64 in contact with the outside wall of the next available bag in the bag supply, horizontal arm 66 may be inwardly biased to retract arm 66 towards the back wall. Alternatively, monitor 64 may be biasedly mounted in a longitudinal slot of arm 66 so it moves towards the back wall as bags are removed from the bag supply. By remaining engaged with the next available bag, monitor 64 is in position to open and close an electrical switch as the bags are removed from the supply.

Figure 3:
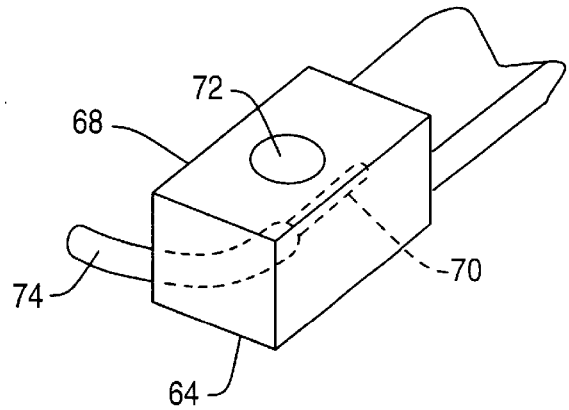
FIG. 3 shows the movable arm unit in greater detail.

FIG. 3 shows the bag supply monitor in greater detail. Housing 68 of monitor 64 may be fixedly mounted to end of member 66. A moveable arcurate arm 74 is rotatably mounted within housing 68 so the outboard point of arm 74 may rest against the outside wall of the next available bag in the supply. A biasing member, such as a spring 70, may be mounted between a fixed point in housing 68 and some portion of arm 74. Thus, as the outboard end of arm 74 is rotated outwardly by the outer wall of the bag being pulled out for depositing items, the biasing member exerts a return pull on arm 74. When the bag is filled and removed, the biasing member returns arm 74. The retracting movement of member 66 or of monitor 64 in the slot of member 66 helps ensure that the outboard end of arm 74 comes to rest against the next available bag in the supply. The outward movement of arm 74 and its return may be used to operate, either mechanically, magnetically, or the like, electrical switch 72. Electrical leads within member 66 are coupled to switch 72 so a bag removal signal is provided to a low bag supply generator in checkout stand 18. The low bag supply generator may include a counter for counting the number of removed bags to determine when a low bag supply condition occurs. The counter may be a countdown counter that may be initialized with a low bag supply threshold value corresponding to a full bag supply when an attendant loads a full bag supply on arms 50*a* and 50*b*. Alternatively, the counter may count up and be initialized to zero when the bag supply is reloaded along with a low bag supply threshold value. In the count down version, a low bag supply signal is generated when the counter reaches zero. In the count up version, a comparator compares the count of the accumulating counter to the low bag supply threshold and a low bag supply signal is generated when the count reaches the low bag supply bag threshold value. The low bag supply signal may be transmitted as a wireless or wired signal to the attendant station to signal the need for the attendant to schedule the task of reloading the bag supply. Otherwise, the low bag supply signal may be used to activate one of the lights 54 on indicator pole 52 to indicate the need to schedule the task to the attendant.

To avoid the need for a retracting member 66 or a slot in which the bag monitor may be retracted, bag monitor 64 may be fixedly mounted to a position on a rigid member 66. Preferably in this embodiment, bag monitor 64 is placed at a location near the end of the bag supply and the outboard end of arm 74 is inserted in the bag supply so it rests against the outside wall of one of the bags in the supply. Thus, when the bag against which arm 74 rests is removed, the operation of electrical switch is a low bag supply signal that may be delivered to the attendant station or used at the checkout stand to indicate the need to schedule the reloading of the bag supply.

In an alternative embodiment of the present invention, bag monitor 64 may be a light or other radiation detector. When mounted to the end of a retracting member 66, the radiation detector toggles a signal in response to the attenuation of radiation received by the detector followed by the exposure of the detector to the radiation. For example, when the outside wall of a bag is pulled out so items may be deposited in the bag, the transmission of light to the detector is blocked and when the filled bag is removed, the detector is exposed to radiation and radiation impinges on the detector again. The radiation may be ambient light or it may be light or other radiation from a radiation source opposed to the detector so the loading of a bag and its removal causes the detector to generate a bag removal signal for a counter. Alternatively, the radiation detector may be located at a position near the end of the bag supply so the detector is substantially blocked from the radiation source until a major portion of the bag supply has been removed. Then the detector is exposed and radiation impinges on the detector and the radiation detector generates a low bag supply signal. In yet another embodiment, a radiation detector may be located on the floor of bagwell 46 and uncovered when one of the interior bags within a supply is removed. When uncovered the light or other radiation detector may generate a low bag supply signal in response to the exposure of the detector to radiation caused by the removal of the bag.

In yet another embodiment of the present invention, a retractable arm such as displaceable member 66 is provided in a bagwell 46 without a bag monitor mounted at its outboard end or along its length. An generally orthogonal member fixed extends from the outboard end of the retracting arm so the outboard end remains substantially registered with the outboard end of the bag supply. Thus, the length of the retracting arm extending into bagwell 46 corresponds to the remaining bag supply while the length of the arm within the checkout stand corresponds to the number of bags used. A device that measures one of these lengths of the retracting arm may be used to determine when a low bag supply condition has been reached. For example, a magnetic switch may detect magnetic markers mounted along the length of the retracting arm to the length of the retracted arm within the checkout stand and a comparator may compare the accumulated count of these markers to a threshold value to determine a low bag supply condition.

Figure 4A:
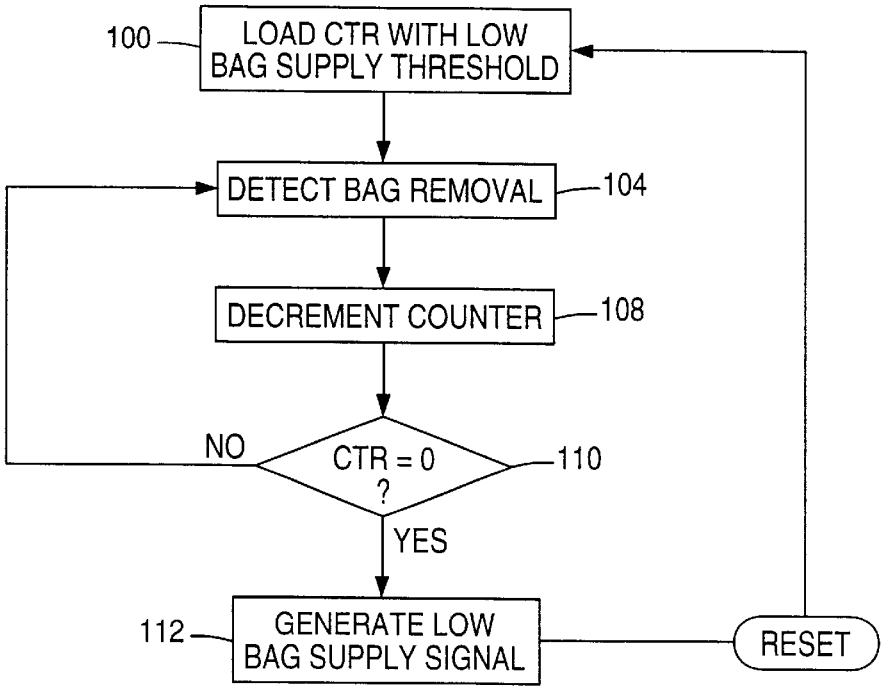
FIGS. 4A and 4B are flowcharts of exemplary methods that count bag removals to generate low bag supply signals.
Figure 4B:
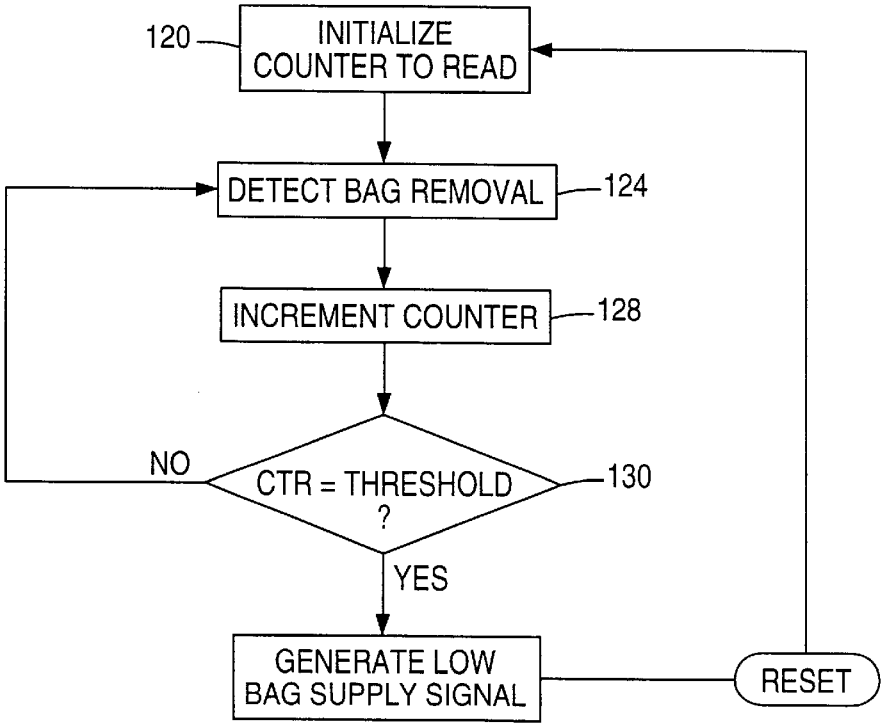

Exemplary methods of the present invention that use counters are shown in FIGS. 4A and 4B. The method of FIG. 4A counts a low bag supply threshold value down to zero while the method of FIG. 4B accumulates a count for comparison to a low threshold value. As shown in FIG. 4A, a counter is loaded with a low bag supply threshold value (block 100). Removal of a bag from the bag supply is detected (block 104) and the counter is decremented (block 108). If the value in the counter has reached zero (block 110), the low bag supply signal is generated (block 112). Otherwise, the process continues detecting bag removals (block 104) and decrementing the counter (block 108) until the number of bags counted corresponds to the low bag supply threshold value. Once the bag supply is replenished, the attendant resets the operation of the monitor program so the threshold value is loaded (block 100) and the process continues for the new supply. Preferably, the low bag supply threshold value is less than the number of bags loaded onto rails 50*a* and 50*b* so the attendant has time to schedule the bag supply reloading task. As shown in FIG. 4B, a counter is initialized to zero (block 120). Removal of a bag from the bag supply is detected (block 124) and the counter is incremented (block 128). The value in the counter is compared to the low bag supply threshold value (block 130). If the counter value is greater than the threshold value (block 134), the low bag supply signal is generated (block 138). Otherwise, the process continues detecting bag removals (block 124) and incrementing the counter (block 128) until the number of bags counted corresponds to the low bag supply threshold value.

Figure 5A:
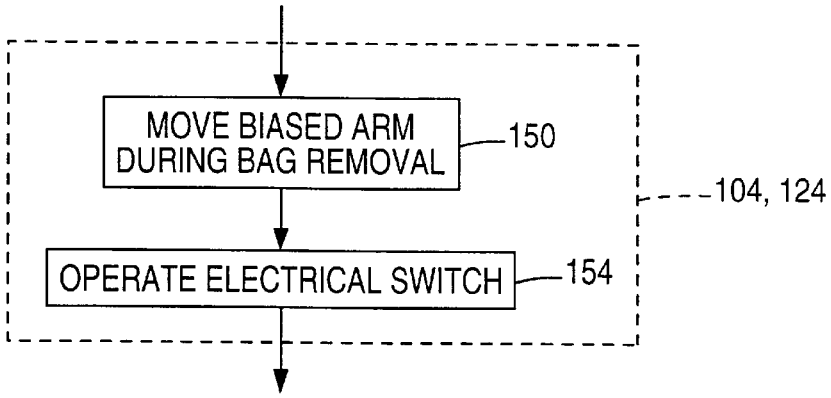
FIGS. 5A, 5B, and 5C are flowcharts of exemplary methods for detecting bag removal that may be used in the methods of FIGS. 4A and 4B.
Figure 5B:
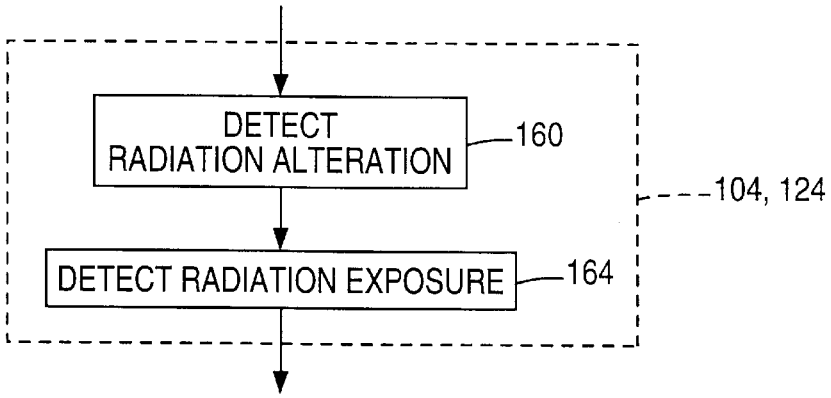
Figure 5C:
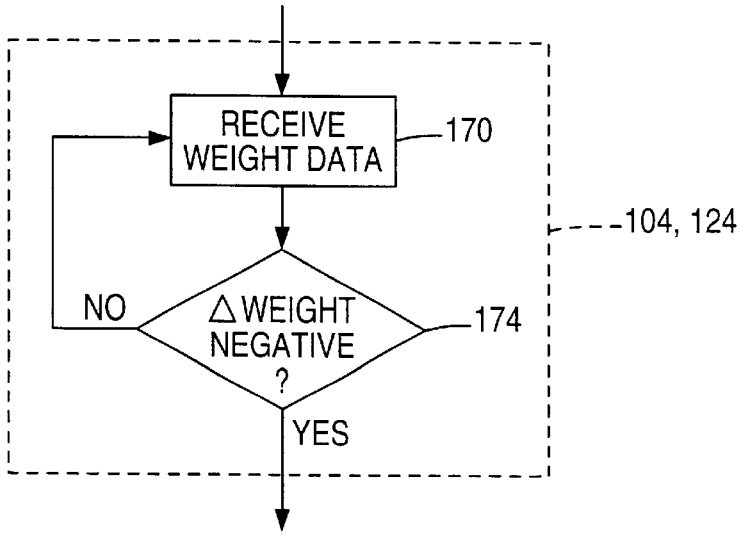

The bag removal detection of FIGS. 4A and 4B may be performed using the methods shown in FIGS. 5A and 5B. In FIG. 5A, moving a biased arm during bag removal (block 150) operates an electrical switch (block 154). The signal generated by the operation of the switch may be counted according to one of the methods in FIG. 4A or 4B. Likewise, detecting attenuation of radiation (block 160) followed by detecting exposure to a source of radiation (block 164) may be used to generate a signal that may be counted by one of the methods in FIG. 4A or 4B. Also, in embodiments where the biased arm or radiation detection is located at a bag within the bag supply, the signal generated by the electrical switch or radiation detector may be used as the low bag supply signal. The method of FIG. 5C may also be used in the counting methods of FIGS. 4A and 4B. The method of FIG. 5C receives weight data from the scales of a checkout stand (block 170) and detects bag removal from a negative weight change (block 174). That is, the addition of an item to a bag causes a positive weight change and when the bag is removed, the resulting weight data of approximately no weight may be used to detect a bag removal that may be counted by one of the methods provided in FIG. 4A or 4B.

Figure 6:
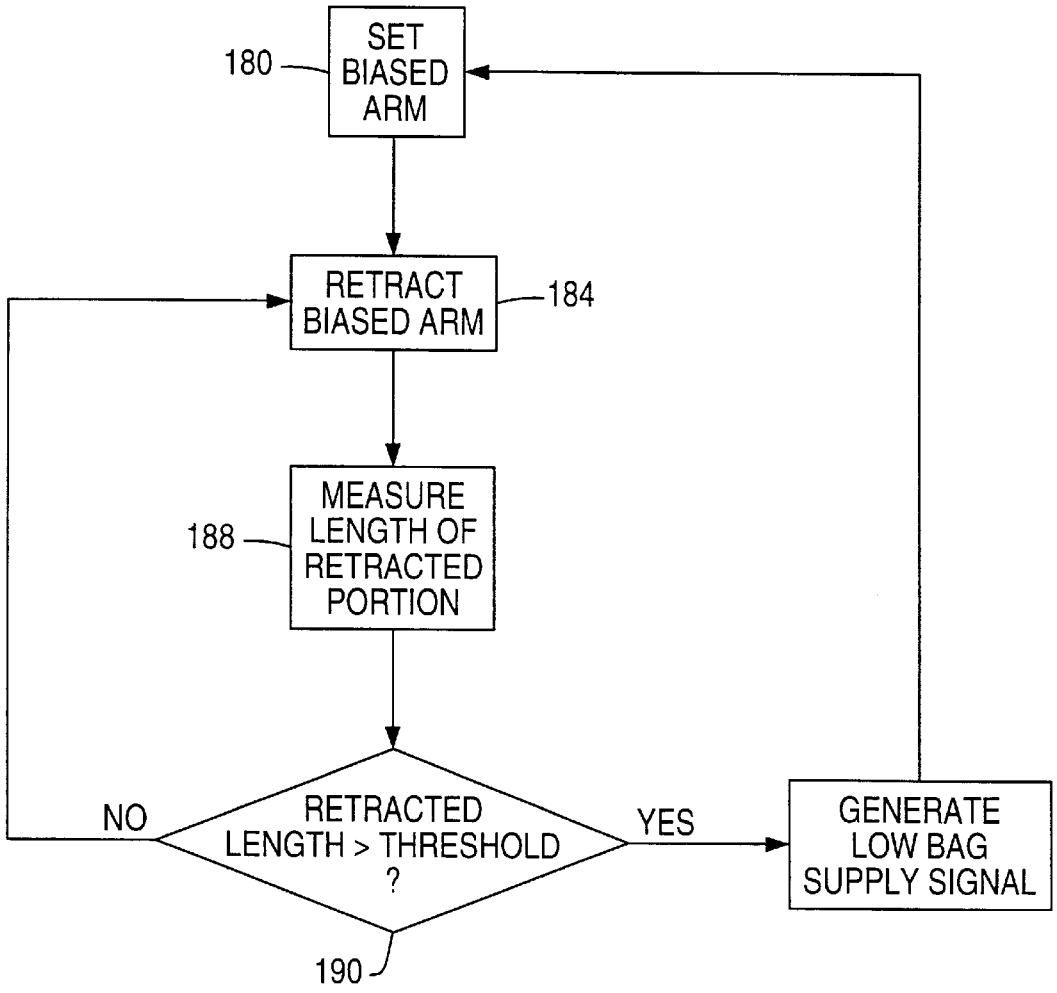
FIG. 6 is a flowchart of an exemplary method for using a biased arm that retracts as bags are removed from the bag supply to monitor the bag supply in a checkout stand.

The method of FIG. 6 may also be used to detect a low bag supply. In that method, a biased arm is set at a position within the bag supply (block 180). The bias action on the arm retracts it as bags are removed from the bag supply (block 184) and the length of the retracted arm is measured (block 188). The length of the arm is compared to a low bag supply threshold value (block 190) and when the length exceeds the threshold value, a low bag supply signal is generated (block 192). Preferably, the biased arm is set at a position within the bag supply that allows a remainder to be available for customers after the low bag supply signal is generated. When the attendant reloads the bag supply, the biased arm must be reset at some location in the bag supply (block 180).

While the present invention has been illustrated by the description of exemplary processes and system components, and while the various processes and components have been described in considerable detail, it is not the intention of the applicant to restrict or in any limit the scope of the appended claims to such detail. For example, the system and method of the present invention may be used in cashier-assisted checkout stations as Well. Additional advantages and modifications will also readily appear to those skilled in the art. The invention in its broadest aspects is therefore not limited to the specific details, implementations, or illustrative examples shown and described. Accordingly, departures may be made from such details without departing from the spirit or scope of applicant's general inventive concept.

What is claimed is:

1. A system for detecting a low bag supply in a checkout station comprising:

a bag supply monitor for measuring a bag supply in a checkout counter including a horizontally displaceable member;

a biased movable arm mounted to the horizontally displaceable member proximately an outboard wall of a bag in the bag supply so that removal of the bag against which the biased moveable arm is mounted causes the biased moveable arm to rotate outwardly to release the bag and return to rest against a next available bag;

an electrical switch coupled to the biased moveable arm so that outward movement of the moveable arm and return of the moveable arm open and close the electrical switch to generate a low bag supply signal; and a counter coupled to the electrical switch to count removed bags; and a low supply signal generator coupled to the bag supply monitor for generating a low bag supply signal in response to the bag supply monitor detecting a low bag supply.

2. The system of claim 1 wherein the counter is a countdown counter and the low bag signal generator generates the low bag supply signal in response to the counter reaching zero.

3. The system of claim 1 wherein the counter is an accumulating counter and the system further includes:

a comparator for comparing a count of the accumulating counter to a low bag supply threshold; and wherein the low paper supply signal generator generates the low bag supply signal in response to the comparator determining that the count of the accumulating counter exceeds the low bag supply threshold.

4. The system of claim 1, the bag supply monitor includes:

a scale for measuring a weight of a bag in which items are being deposited; and a monitor program for receiving weight data from the scale and determining the bag with the items has been removed from the scale so that another count of bags in the bag supply may be maintained.

5. The system of claim 1, the bag supply monitor further comprising:

a radiation detector mounted proximately the outboard wall of the bag in the bag supply so that opening of the bag against which the biased moveable arm is mounted to fill the bag attenuates the reception of radiation by the radiation detector and removal of the bag exposes the detector to radiation; and wherein the low bag supply signal generator generates the low bag supply signal in response to attenuation and subsequent exposure of the detector to radiation.

6. The system of claim 1 further comprising:

a biased, horizontally retractable member to which a radiation detector is mounted so that the radiation detector moves as each bag is removed from the supply;

another counter coupled to the radiation detector to count the removed bags; and wherein the low bag supply signal generator generates the low bag supply signal in response to a count of the removed bags from the other counter exceeding a low bag supply threshold.

7. A method for detecting a low bag supply in a checkout station comprising:

measuring a bag supply in a checkout counter by a bag supply monitor including moving a biased arm mounted proximately an outboard wall of a bag within the bag supply so that the bag is released;

retracting a member to which the biased arm is mounted so that the biased arm returns against a next available bag in the bag supply and operates an electrical switch; and counting electrical switch operations associated with removal of bags; and generating a low bag supply signal in response to the bag supply monitor detecting a low bag supply, wherein generation of the low bag supply signal occurs in response to a count of removed bags exceeding a low bag supply threshold.

8. The method of claim 7 wherein the counting step decrements a counter and generation of the low bag signal occurs in response to the counter reaching zero.

9. The method of claim 7 wherein the counting increments a counter and the method further includes:

comparing a count of the counter to a low bag supply threshold;

wherein generation of the low bag supply signal occurs in response to the count of the counter exceeding the low bag supply threshold.

10. The method of claim 7, the bag supply measurement further includes:

receiving weight data from a scale; and determining the bag has been removed from the scale from the received weight data so that another count of bags in the bag supply may be maintained.

11. The method of claim 7, the bag supply measurement further comprising:

detecting attenuation and subsequent exposure of radiation in response to removal of the bag from the bag supply; and wherein generation of the low bag supply signal occurs in response to the attenuation and subsequent exposure of the detector to radiation.

12. The method of claim 7 further comprising:

retracting a member to which a radiation detector for detecting attenuation and exposure is mounted so that the radiation detector detects bag removals and moves as each bag is removed from the supply;

counting bag removals detected by the radiation detector; and wherein generation of the low bag supply signal occurs in response to the count of the number of bag removals exceeding a low bag supply threshold.

13. A system for detecting a low bag supply in a checkout station comprising:

a bag supply monitor for measuring a bag supply in a checkout counter including a scale for measuring a weight of a bag in which items are being deposited, and a monitor program for receiving weight data from the scale and determining a bag has been removed from the scale so that a count of bags in the bag supply may be maintained; and a low supply signal generator coupled to the bag supply monitor for generating a low bag supply signal in response to the bag supply monitor detecting a low bag supply.

14. A system for detecting a low bag supply in a checkout station comprising:

a bag supply monitor for measuring a bag supply in a checkout counter including a radiation detector mounted proximately an outboard wall of a bag in the bag supply so that opening of the bag against which a biased moveable arm is mounted to fill the bag attenuates the reception of radiation by the radiation detector and removal of the bag exposes the detector to radiation; and a low supply signal generator coupled to the bag supply monitor for generating a low bag supply signal in response to the attenuation and subsequent exposure of the detector to radiation.

15. A system for detecting a low bag supply in a checkout station comprising:

a bag supply monitor for measuring a bag supply in a checkout counter including a biased, retractable arm having an outboard end proximately located at a next available bag of a bag supply, the biased arm retracting as the bag supply diminishes so that the length of the retracted arm corresponds to the remaining bag supply; and a low supply signal generator coupled to the bag supply monitor for generating a low bag supply signal in response to the length of the retracted arm exceeding a low bag supply threshold.

16. A method for detecting a low bag supply in a checkout station comprising:

measuring a bag supply in a checkout counter by a bag supply monitor including moving a biased arm mounted proximately an outboard wall of a bag within the bag supply so that the bag is released and the biased arm operates an electrical switch;

retracting a member to which a radiation detector for detecting attenuation and exposure is mounted so that the radiation detector detects bag removals and moves as each bag is removed from the supply;

counting bag removals detected by the radiation detector to provide a first count;

counting electrical switch operations to provide a second count; and generating a low bag supply signal in response to the bag supply monitor detecting a low bag supply from the first and second counts.

17. A method for detecting a low bag supply in a checkout station comprising:

measuring a bag supply in a checkout counter including retracting a biased arm having an outboard end proximately located at a next available bag of a bag supply as the bag supply diminishes so that a length of the retracted arm corresponds to a remaining bag supply; and measuring the bag supply in accordance with the length of the biased arm; and generating a low bag supply signal in response to the bag supply monitor detecting a low bag supply.

* * * * *